US006433761B1

(12) United States Patent
Remitz

(10) Patent No.: US 6,433,761 B1
(45) Date of Patent: Aug. 13, 2002

(54) DISPLAY DEVICE WITH SEVERAL LIGHT SOURCES AND ARRANGEMENT OF DISPLAY DEVICES

(75) Inventor: Hans-Jörg Remitz, Ritterhude (DE)

(73) Assignee: Kohne Ingenieurburo GmbH, Bremen (DE)

( * ) Notice: Subject to any disclaimer, the term of this patent is extended or adjusted under 35 U.S.C. 154(b) by 0 days.

(21) Appl. No.: 09/230,246

(22) PCT Filed: Jul. 24, 1997

(86) PCT No.: PCT/EP97/04003

§ 371 (c)(1),
(2), (4) Date: May 27, 1999

(87) PCT Pub. No.: WO98/05023

PCT Pub. Date: Feb. 5, 1998

(30) Foreign Application Priority Data

Jul. 25, 1996 (DE) ..... 196 30 011

(51) Int. Cl.[7] ..... G09G 3/00; G08B 5/00

(52) U.S. Cl. ..... 345/31; 340/815.87

(58) Field of Search ..... 345/4–6, 31, 46, 345/82, 83; 340/815.83, 815.84, 815.86, 815.45, 815.87

(56) References Cited

U.S. PATENT DOCUMENTS

| | | | | | |
|---|---|---|---|---|---|
| 1,711,859 | A | * | 3/1929 | Samminiatelli | 345/31 |
| 4,160,973 | A | * | 7/1979 | Berlin, Jr. | 345/31 |
| 4,689,604 | A | * | 8/1987 | Sokol | 345/31 |
| 5,057,827 | A | * | 10/1991 | Nobile et al. | 345/31 |
| 5,202,675 | A | * | 4/1993 | Tokimoto et al. | 345/31 |
| 5,302,965 | A | * | 4/1994 | Belcher et al. | 345/31 |
| 5,670,971 | A | * | 9/1997 | Tokimoto et al. | 345/31 |
| 5,717,416 | A | * | 2/1998 | Chakrabarti | 345/31 |
| 5,818,401 | A | * | 10/1998 | Wang | 345/31 |

FOREIGN PATENT DOCUMENTS

| | | |
|---|---|---|
| DE | 41 05 709 | 8/1992 |
| DE | 44 12 520 | 12/1994 |
| DE | 9414053 | 1/1995 |
| DE | 94 14 053 | 12/1995 |
| DE | 19502735 | 8/1996 |
| EP | 0 156 544 | 3/1984 |
| EP | 0156544 | 10/1985 |
| EP | 0 359 218 | 9/1989 |
| EP | 0546844 | 6/1993 |
| EP | 0 703 558 | 12/1994 |
| FR | 78 30939 | 10/1978 |
| GB | 1 241 369 | 8/1971 |
| GB | 2053547 | 2/1981 |
| GB | 2 277 189 | 10/1994 |
| WO | WO 8802908 | 4/1988 |
| WO | WO 96/11462 | 4/1996 |

* cited by examiner

*Primary Examiner*—Bipin Shalwala
*Assistant Examiner*—Jeff Piziali

(57) ABSTRACT

A display device having a multiple columnar arrangement of colored light sources on a carrier. The carrier and mounted light sources are moved, either rotated or swung as a pendulum, within the display device to create a recurring visual image. A control unit within the display device controls actuation of the colored light sources and movement of the carrier such that individual colored light sources are actuated at a point within a surface region to achieve a color mixing at that point.

31 Claims, 12 Drawing Sheets

DISPLAY DEVICE WITH SEVERAL LIGHT SOURCES AND ARRANGEMENT OF DISPLAY DEVICES

BACKGROUND OF THE INVENTION

The invention concerns a display device for generating a display using a light source array with individually actuable light sources, which are adapted to be excited or lit by means of a control unit. Hitherto conventional display devices have generally been used in advertising or in conjunction with display apparatuses having a plurality of light sources arranged in the form of a chain or matrix, and information was displayed by either lighting all the light sources in the light source chain or lighting a selected portion of the light sources in the light source matrix.

When a light source chain is used, for example, to display an alphanumeric character, then such an arrangement only allows the display of a respectively desired alphanumeric character. However, when a light source matrix is used various alphanumeric characters can be generated. In the case of a light source matrix arrangement, however, a very large number of light sources are required in order to represent a multiplicity of alphanumeric characters. With a 10×20 matrix, for example, 200 individual light sources are required. Conventional light sources include light emitting diodes, incandescent lamps, and LCD-elements. Unfortunately, when compared to display devices having few light sources, the use of a light source matrix comprising many light sources comes at a high cost in terms of hardware and the probability of failure for an individual light source.

European Patent document EP 0 359 218-A discloses a display instrument in which lighting elements which are linearly oriented on a pointer moved transversely with the motion of the pointer while a control circuit switches the lighting elements ON and OFF in relation to an instantaneous position of the pointer in order to form display symbols during the pointer movement. In this arrangement, the pointer can be moved to and fro like a pendulum or it can be continuously rotated.

In addition, Patent Abstracts of Japan, No 59-195 181, relating to Application No 50-70553, assigned to applicants Seikoushiya K.K. discloses a display device similar to that described in EP 0 359 218-A in which lighting elements arranged on a pendulum arm are moved transversely to and fro in relation to their linear orientation within a predetermined unit of time, so that the display of a desired item of information is generated using the so-called after-image phenomenon.

The display principle which is known from the above-described publications is distinguished in that only a relatively few light sources are required, and that it is possible to generate a display for which the viewer cannot discern any display carrier such as, for example, a television picture tube, but rather the viewer sees the display as virtually floating freely in space in front of a background.

BRIEF SUMMARY OF THE INVENTION

The object of the present invention is to design a display device on the basis of the after-image phenomenon in a simple and inexpensive manner and to allow a high degree of display variability. The invention further seeks to provide a practically noise-less display device.

This object is attained within the context of the present invention by a display device including a plurality of light sources arranged on a carrier, and a control device for actuation of an individual light source and/or a sub-group of light sources.

The present invention includes a drive coupled to the carrier are controlled by the control device such that it repeatedly moves the carrier and the light sources over a surface region a plurality of times within a given unit of time.

The present invention also includes a storage means connected to the control means which stores data corresponding to an item of display information, and a device for detecting the position and/or motion information for the carrier, wherein the position and/or motion information is transmitted to the control device and the plurality of light sources is controlled by the control device in relation to the position and/or motion information of the display information.

Advantageous developments are described in the attached claims as well as an arrangement comprising a plurality of display devices.

It has been found that, when the carrier is driven in a contact-less mode, it is possible to construct a noiseless display device. Such a contact-less drive for the carrier can be afforded by an electromagnetic unit or a solenoid, which cyclically exposes a pendulum arm in the form of the carrier to an attraction and/or repulsion force.

In addition, a contact-less drive as well as the contact-less detection of the information regarding position and/or motion of the carrier has the advantage that the amount of wear of the display device according to the invention is held to a minimum. Furthermore, contact-less data transmission from a fixed part of the display device to the moving part of the display device is also advantageous, and may be accomplished, for example, by contact-less coupling of the control device with to the carrier and the light sources disposed thereon.

If nonetheless the movement of the carrier, either in the case of pendulum movement or rotational movement about a cylindrical path, should yet give rise to acoustic noises, such noise may be counteracted by use of a carrier having an aerodynamically favourable configuration. One of ordinary skill in the art will appreciate that a carrier having such an aerodynamic configuration will be formed like an aircraft wing, and will avoid configurations having sharp corners or other discontinuous contours which tend to cause acoustic disturbance noises.

It has also proven to be highly desirable that, to detect information with respect to the position and/or motion of the carrier, a detector, preferably an optical detector arrangement or proximity switch, is used, so that a position and/or motion information signal is generated in relation to the position and/or motion of the carrier. The control device thereafter uses the information signal as a reference signal for light source control purposes and for drive control purposes. The production of acoustic noises is also prevented by use of contact-less detection schemes described above.

By virtue of the reference signal, the control device can exactly implement the actuation of an individual light source and at a particular time and can also control the drive in such a way that the carrier is repeatedly moved over the display surface with sufficient frequency and at exact time intervals. It is also desirable, if, when a pendulum-like reciprocating motion is involved, the representation generated is produced in each phase of the motion, that is to say in the forward movement and in the return movement of the carrier. In this manner, the level of sharpness of the display is enhanced and at the same time the carrier does not have to be moved over the display surface so frequently.

In addition, the control signal can switch each individual light source on and off, in relation to the reference signal and in relation to the items of information to be displayed, in such a way that each individual light source lights up only at a given location on the display surface. Moreover, in the case of a forward movement and a return movement of a pendulum-like display, the display is synchronised in such a way that the display in the forward movement optically overlaps with the display in the return movement.

It is also advantageous if the display device is provided with means for ascertaining the level of ambient brightness so that the lighting strength or power of the light sources can be adjusted in dependence on ambient brightness.

It has also been shown to be highly desirable if, for individual information display, an individual one of the above-mentioned display devices or a plurality thereof is connected to an information input/processing device, wherein the information input/processing device is preferably a personal computer at which by utilisation and by implementation of an editing program provided for display control purposes, the user is capable of inputting the content of the information to be displayed. For that purpose, the content to be displayed is first placed into an intermediate storage in the personal computer memory and thereafter transferred with a suitable command on the part of the user to a selected display unit where the display information is then stored in a related storage means.

It is moreover advantageous if, in the case of an arrangement comprising a plurality of display devices, each individual display device has an individual address which allows the user to be displayed the item of information to be displayed, on a selected display unit.

The display principle of the above-described display device is based on the fact that, when a plurality of light sources are repetitively moved in a constant manner over a given surface, it is possible to generate a display which is built up in line form, as an individual light source repeatedly passes over the same portion of the surface. If an individual light source is switched on or off during the motion, a particular optical lighting effect can be produced for a viewer in the respective display line. If the light sources move a plurality of times per second over a given region, then an apparently still image is produced for the viewer by the cooperation of the excited light sources, without the viewer even seeing the carrier of the light sources within the display surface. As a result, an image, formed from the switched light sources, produces a display image for which the viewer cannot detect an image carrier so long as the motion of the carrier and the associated the light sources is just so fast enough such that the carrier itself can not be identified. In this respect the invention makes use of a psycho-optical persistence effect which always occurs in the event of rapid movements of light and which is well known, for example, in the film and television industry, where ultimately movements are produced by means of some 25 still images per second being produced on the television or movie screen. The succession of closely consecutive different static events like successive still images which differ in given points produces on the part of the viewer the impression of a movement.

Due to the movement of the individual light sources over the surface region, an imaginary matrix is produced, in which the ratio of the number of light sources and the matrix points or dots is very small. For example it is possible without difficulty to create an imaginary matrix of about 8×(50 to 200) picture elements with only 8 light sources which are disposed linearly in a straight line and which are rapidly reciprocated in a motion transverse to their straight line orientation, without the quality of the displayed image so produced becoming inadequate. The cost of generating the "imaginary matrix" display in regard to the light sources themselves is therefore drastically reduced in comparison with the conventional light source matrix arrangement. On the other hand, the required movement of the light sources is readily obtained, insofar as, for example, the carrier of the light sources is cyclically reciprocated or rotated about a central point.

An astonishing optical effect can be achieved with the display device according to the present invention. The viewer sees information displayed without discerning the actual carrier of the information producing light sources such as, for example, a picture screen or a representational matrix. Therefore, where the light sources do not light up, the viewer can discern a background behind the display.

The display device according to the present invention can be of a particularly advantageous configuration if the drive moves the carrier of the light sources to and fro like a pendulum or rotates it about a point of rotation. In that case, the light sources are moved for example more than 20 times per second over the same surface within a given unit of time.

A particularly advantageous embodiment is one in which the light sources are arranged one behind the other on a straight line on the free end of a pendulum arm. It is then easily possible to produce a display surface of more than 10 cm in width, each individual light source forming a line of the display.

For information to be displayed, the display device has a storage means which transfers the items of information to be displayed to the control device, either in the form of whole items of information or in the form of individual information in point form. If the display device serves as a clock, the display device includes a timer which transmits items of time information corresponding to a time signal to the control device which in turn, by way of the light sources, displays the time information in digital and/or analog form as the clock time.

Therefore, the control device converts a signal for an item of information to be displayed, for example a number, into actuation signals for each individual light source so that the light sources are excited to light up at a given moment in time and at a given position.

It will be appreciated that it is also possible for items of information to be displayed not just statically but also as moving writing or lettering on the display device. For that purpose, the position at which a light emitting diode lights up is only displaced towards one side of the display surface between successive passes.

BRIEF DESCRIPTION OF THE DRAWINGS

The invention is described in greater detail hereinafter by means of one or more embodiment(s) illustrated in the drawings in which.

DETAILED DESCRIPTION OF THE INVENTION

Figure 1:
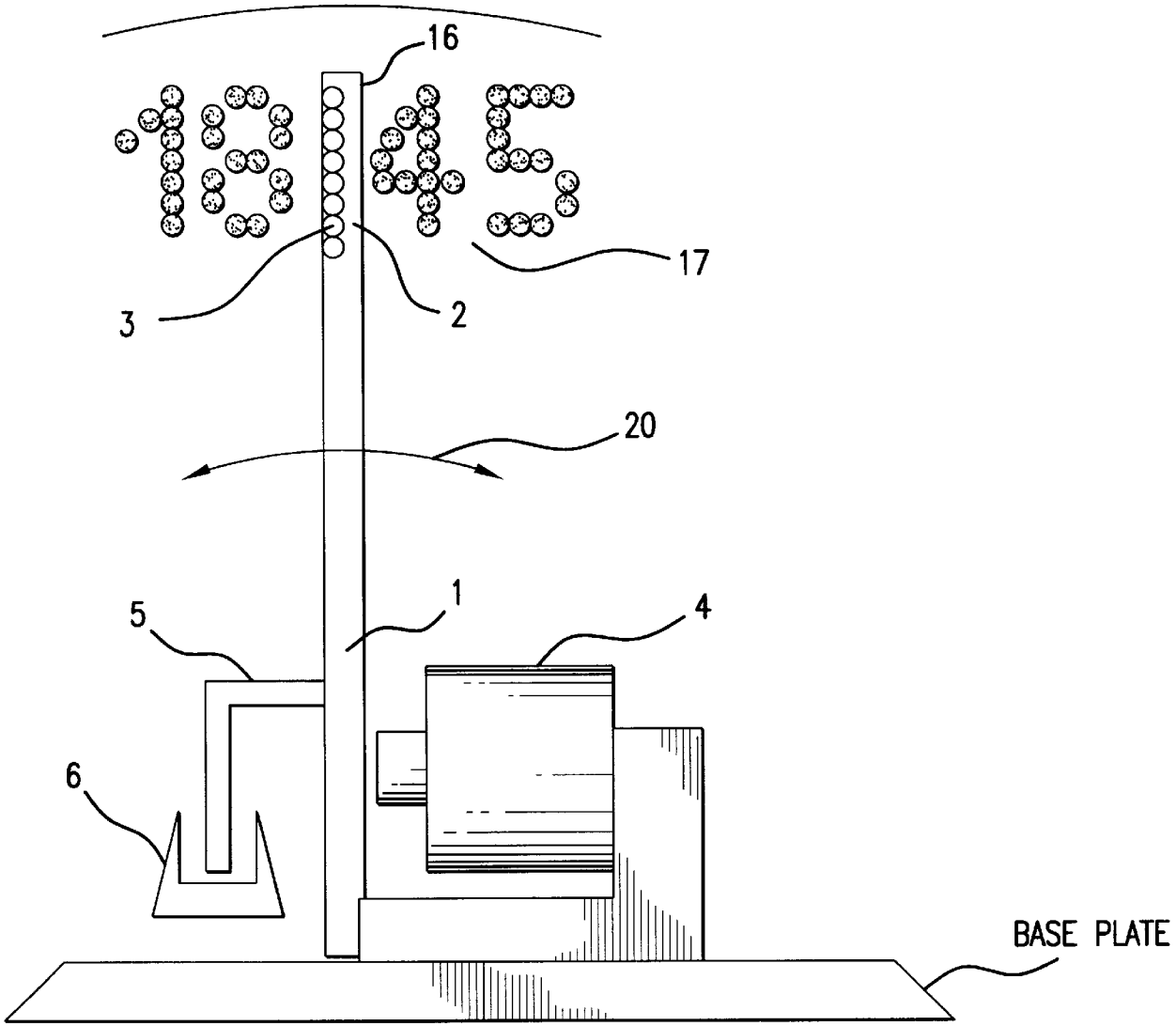
FIG. 1 is a plan view showing the principle of the display according to the invention.

FIG. 1 shows a carrier 2 which is in the form of pendulum arm 1 and on which light sources 3 in the form of light emitting diodes are arranged on the axis of the pendulum arm in a row in an array 16. The pendulum movement is excited by an electromagnetic unit or solenoid 4 which as a drive moves the pendulum arm 1 cyclically to and fro through at least a plurality of oscillation each second, for example more than 10 times. In a given position in the deflection movement of the pendulum, a portion 5 which can project parallel from the pendulum arm 1 or which coincides with the pendulum arm passes through or breaks an optical detector arrangement 6, so that the movement of the pendulum arm generates a rectangular signal as a reference signal 15—see FIGS. 3*a* and 3*b*—or a reference pulse. The optical detector arrangement 6 comprises a light generator in the form of an infrared LED and a detector. If the optical detector is interrupted by the portion 5 which is in the form of a reference plate, the reference pulse signal is generated in the connected control device 7—see FIG. 2.

Figure 2:
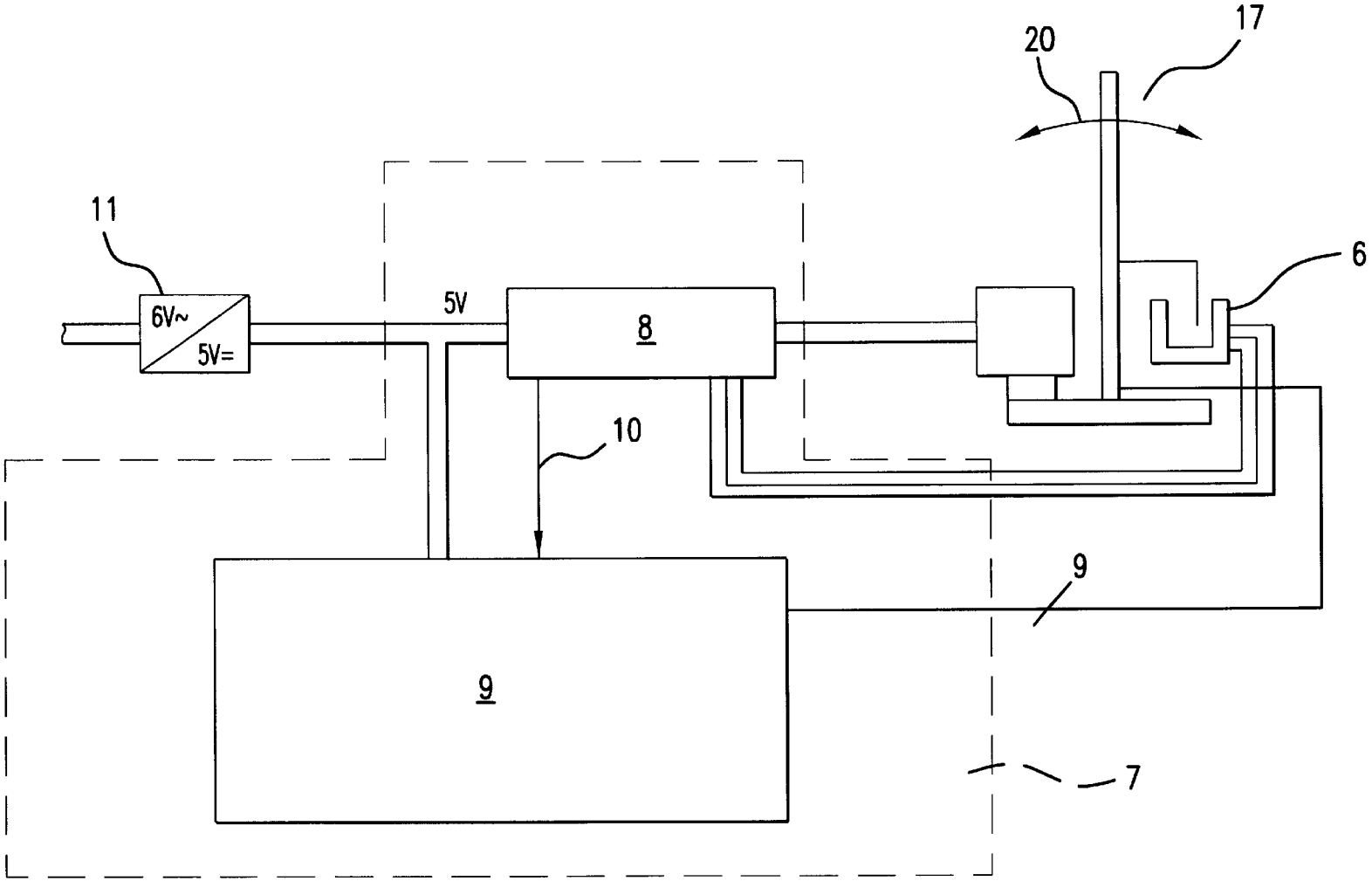
FIG. 2 is a schematic block circuit diagram of the display according to the invention.

The drive is controlled in relation to the reference signal, by a control device 7—see FIG. 2. In that respect, the control device 7 provides that the pendulum 1 is excited as accurately as possible and thus performs an accurate movement, and in that respect passes over the same surface 17 with a predetermined frequency each second, for example more than 10 times per second, such that the pendulum arm 1 itself can no longer be discerned in the region of the display surface 17. It is only at the reversal points in its oscillation that the pendulum arm 1 is apparent to the viewer as a line.

The control device 7 in FIG. 2 comprises a pendulum electronic unit 8 as the drive control and a control processor which is in the form of a microcomputer 9 which generates control signals for the light sources 3 in the form of switch-on and switch-off pulses. The electronic pendulum circuit 8 is connected to the optical detector arrangement 6, which has a light generator and a detector. The signal which is excited by the movement of the pendulum arm 1 at the detector is produced in the pendulum electronic unit 8 or already at the detector itself in the form of a reference pulse signal 15 and is fed to the microcomputer 9 by way of a suitable line 10. At the same time, for each oscillation 20—see FIGS. 3*a* and 3*b*—of the pendulum arm 1, a magnetic pulse signal 18 is output to drive 4 which is in the form of the electromagnetic unit or solenoid, such that the pendulum arm 1 performs a stable and regular pendulum movement. It is highly advantageous if the pendulum arm is excited in such a way that it oscillates at its natural resonance frequency as then the power consumption for the drive is extremely slight. The natural frequency of the pendulum is determined by the pendulum mass and by the geometrical dimensions of the pendulum. The described drive operates entirely without mechanical wear as the pendulum is excited in a contact-less manner by the electromagnetic unit or solenoid. This guarantees a totally noise-less and wear-free drive.

The entire display device is supplied with 5 volts DC voltage, which is furnished by a mains unit 11, which converts an AC voltage into DC voltage. It will be appreciated that it is also possible to ensure the necessary electrical power supply by means of batteries, accumulators or solar cells, which are mounted on the display device.

The microcomputer 9 includes a storage means or memory and/or a clock, which prepares or holds in store data corresponding to information to be represented. At the same time the microcomputer implements conversion of the information to be represented into suitable actuation signals for each individual light source. For that purpose the reference signal is used for timed switching-on and switching-off of the light sources and thus for information display.

The relationship between reference pulse, magnetic pulse, pendulum oscillation build-up and information display is described hereinafter with reference to FIG. 3.

Figure 3A:
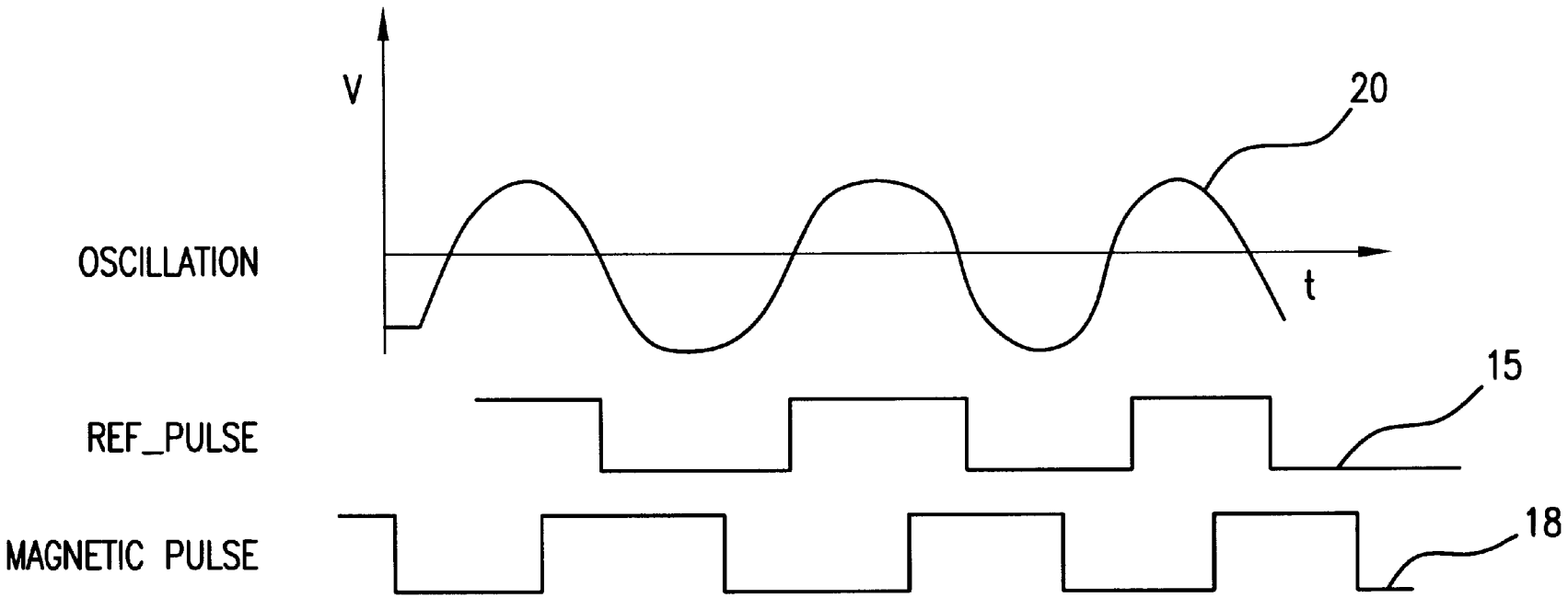
FIG. 3 shows timing diagrams of the device according to the invention.
Figure 3B:
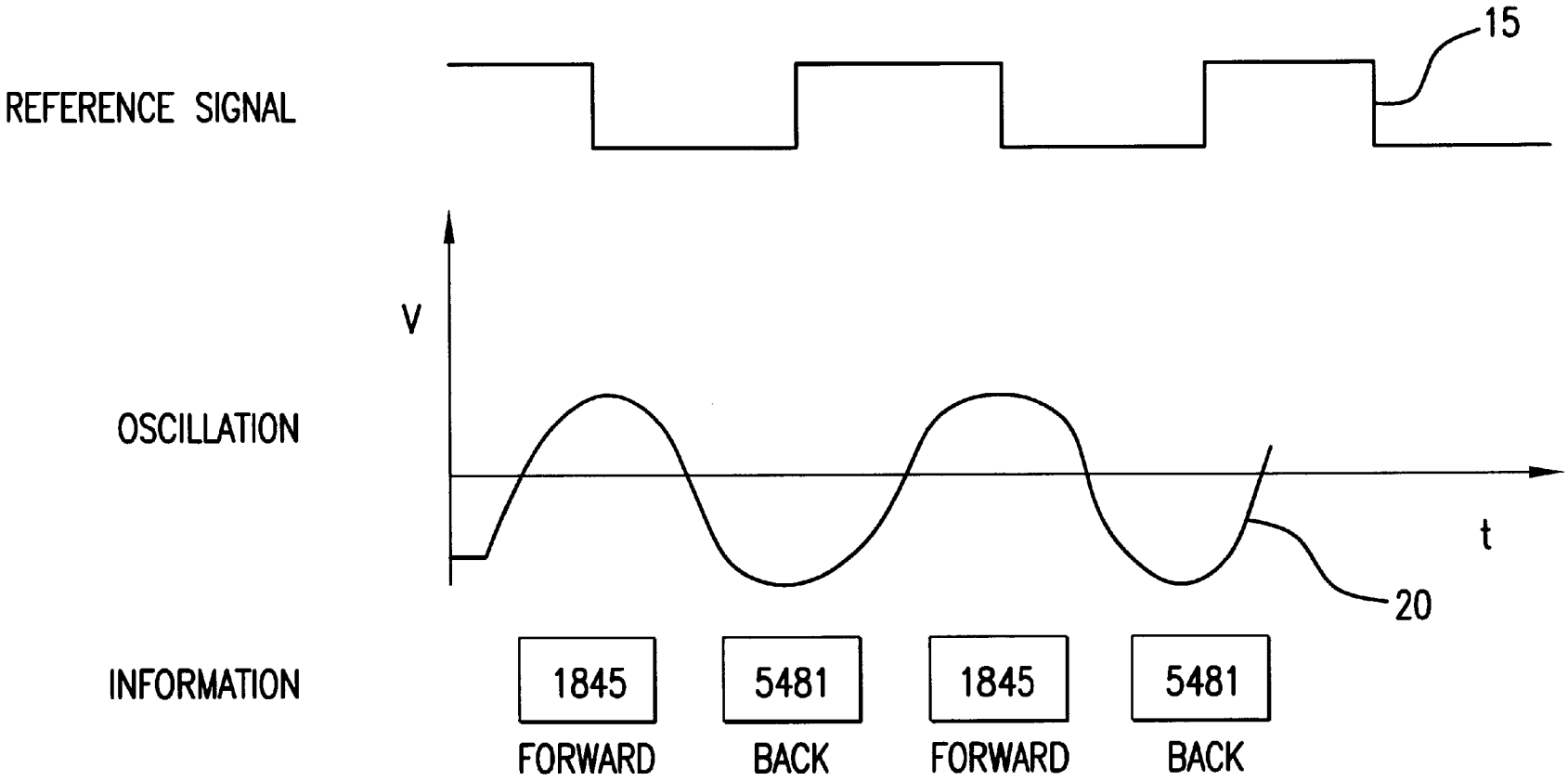

It should be pointed out that FIGS. 3*a* and 3*b* each represent diagrammatic illustrations of the pulse and oscillation configurations, but they are not representations, which are exact in respect of time.

FIG. 3*a* shows the relationship between the reference pulse and magnetic pulse and between the oscillation configuration and pattern. It will be noted that the magnetic pulse signal only represents a rectangular pulse signal, which is displaced relative to the reference pulse signal. The reference pulse signal experiences a change at each passage-through-zero of the oscillation signal through the time axis, that is to say at the moment at which the pendulum arm reverses its direction of movement.

With reference to FIG. 3*b,* it will be seen that the reference signal, alternatively to FIG. 3*a,* also experiences a change when the speed of the pendulum arm is at its greatest. At the same time it can be seen that information reproduction occurs both in the forward movement of the pendulum arm and also in the return movement of the pendulum arm, that is to say whenever the pendulum arm passes over the display surface. Thus for example, with 12 oscillations of the pendulum arm, the display surface can be passed over 24 times and so-to-speak the light sources are correspondingly actuated 24 times so that 24 display images per second are generated. Such a number of display images per second is sufficient to generate a still image which can be readily discerned by a viewer and the items of information of which could be suitably read. In that situation, the viewer in practice does not perceive the pendulum arm movement itself as the speed of the pendulum arm over the display surface is too great. At the same time the viewer does not perceive the switching-on and switching-off of the individual light sources, but he only sees individual light points which, as shown in FIG. 1, appear in the display in the form of light points which are comparable to a light point matrix.

The microcomputer 9 receives from the electronic pendulum circuit 8 the reference pulse signal 15 which is processed in the microcomputer 9 in such a way that the oscillation of the pendulum is present for the microcomputer as a defined time slice. That time slice is divided into forward-motion and return-motion information. In that time slice, at the correct time, the correct information is then output to the individual light sources so that the result is a clear item of image information which is built up in line form.

The quality of representation can be improved with increasing the speed of the light points or with increasing the number of oscillations. Conversely, by decreasing the speed of the light points or decreasing number of oscillations of the pendulum arm, the representation becomes progressively worse and can scarcely be discerned when the number of oscillations is excessively few, as the persistence of the human eye is then no longer overcome. Synchronisation in the actuation of the light sources in the forward movement and the return movement is defined by the control device 7, such that both items of information (forward movement presented and backward movement presented) are optically superimposed in a coincident positional relationship.

Figure 4:
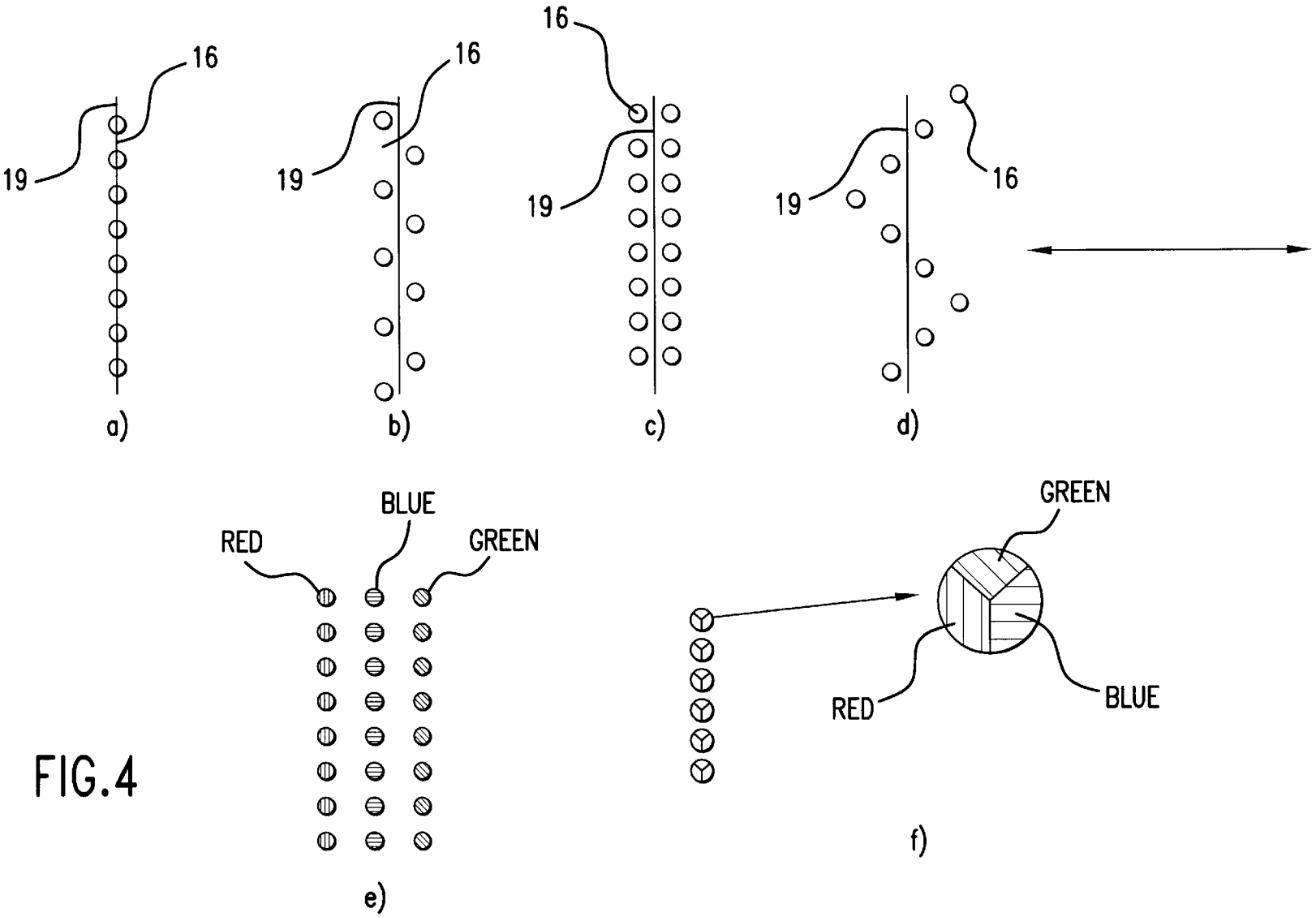
FIG. 4 shows various examples of light source arrangements.

FIG. 4 shows some examples of light source arrangements, which are suitable for the representation of information according to the present invention. FIG. 4*a* shows the light source array 16 illustrated in FIG. 1. All light sources are arranged one over top the other in a straight (columnar) line, like a linear light source chain. In FIG. 4*b*, an equal number of light sources are arranged in an alternating pattern on either side of the carrier as an alternative to FIG. 4*a*. In FIG. 4*c*, two rows of light source points are arranged in side-by-side relationship and in FIG. 4*d* the light source points are disposed in a zigzag formation. Further light source arrays are possible and may be more or less advantageous, depending on the respective situation or use contemplated. What is essential in regard to all light source arrays is that they are moved in a substantial direction of movement which is oriented transversely to a direction 19 of their formation or arrangement, such that each individual light source, alone or together with one or more row-wise adjacent light sources—see FIG. 4*c* and FIG. 4*e*—forms a display line of the display according to the present invention. The light source arrays shown in FIG. 4 each equally permit a nine-line display. FIG. 4*e* shows a light source array of linearly arranged light sources, wherein the light sources arranged in the first vertical row produce red light, those in the second row produce blue light and those arranged in the third row produce green light. A light source array having this arrangement makes it possible to provide colored displays, as the viewer is accustomed to see, from other color reproduction apparatuses such as, for example, a television or a color monitor.

FIG. 4*f* shows a light source array in which an individual light source has three segments, wherein each individual segment is capable of producing a color which is different from the other signals, so that a colored display and reproduction as described hereinbefore is also possible.

The items of information to be displayed can be stored in fixed or volatile form in the storage means or memory contained in the microcomputer 9, or they can be generated by means of a clock or another information-generating means. It is then possible that, instead of a digital clock time display, equally or alternatively thereto, the arrangement affords an analog clock time display in which the dial and the appropriate clock time pointer or hand position are produced with a display according to the present invention. The microcomputer 9 then only effects a mode of light source actuation that is different from when the digital clock time display mode is involved. The display device according to the invention makes it possible to generate all kinds and forms of two-dimensional images which can also be generated with light source matrixes or other display picture screens. Optical wave guides, electric lines or also information buses can serve as a connection of the microcomputer to the light sources. If optical wave guides are used, the light sources employed can be the end portions of the respective optical wave guides which are oriented perpendicularly to the plane of the drawing in FIG. 1 so that the viewer looks onto the end portions.

The clock component which is integrated in the microcomputer and from which the time is read out continues to run even without operation of the mains unit so that there is no need for the clock to be re-set if the voltage supply should sometimes fail. Furthermore it is desirable if the display device has a brightness-measuring device which is also connected (not shown) to the microcomputer 9. The brightness-measuring device measures the ambient brightness and outputs a suitable signal to the microcomputer, which in turn adjusts the light strength or power of the light sources in relation to the measured ambient brightness signal. It is thus possible for example to provide that the light sources light up more brightly in broad daylight than in a darker environment.

In particular light emitting diodes or incandescent lamps are suitable as light sources, but it is also possible to use the end portions of optical wave guides or other known light sources of point form, which can be quickly switched on and off and which require little power.

Conversion of an item of information to be displayed, in the computer, into suitable actuation signals for the light source, is in principle known from actuation of a needle printer which involves the transmission of a defined item of information to the individual needles in each position. The horizontal travel of the print head of the needle printer over the paper subsequently shows the information involved. The principle of a needle printer is used in the present invention in a similar manner for switching the light sources on and off, in which respect the light source carrier, as described, has to be moved with sufficient speed so as to overcome the persistence of the human eye.

Figure 6:
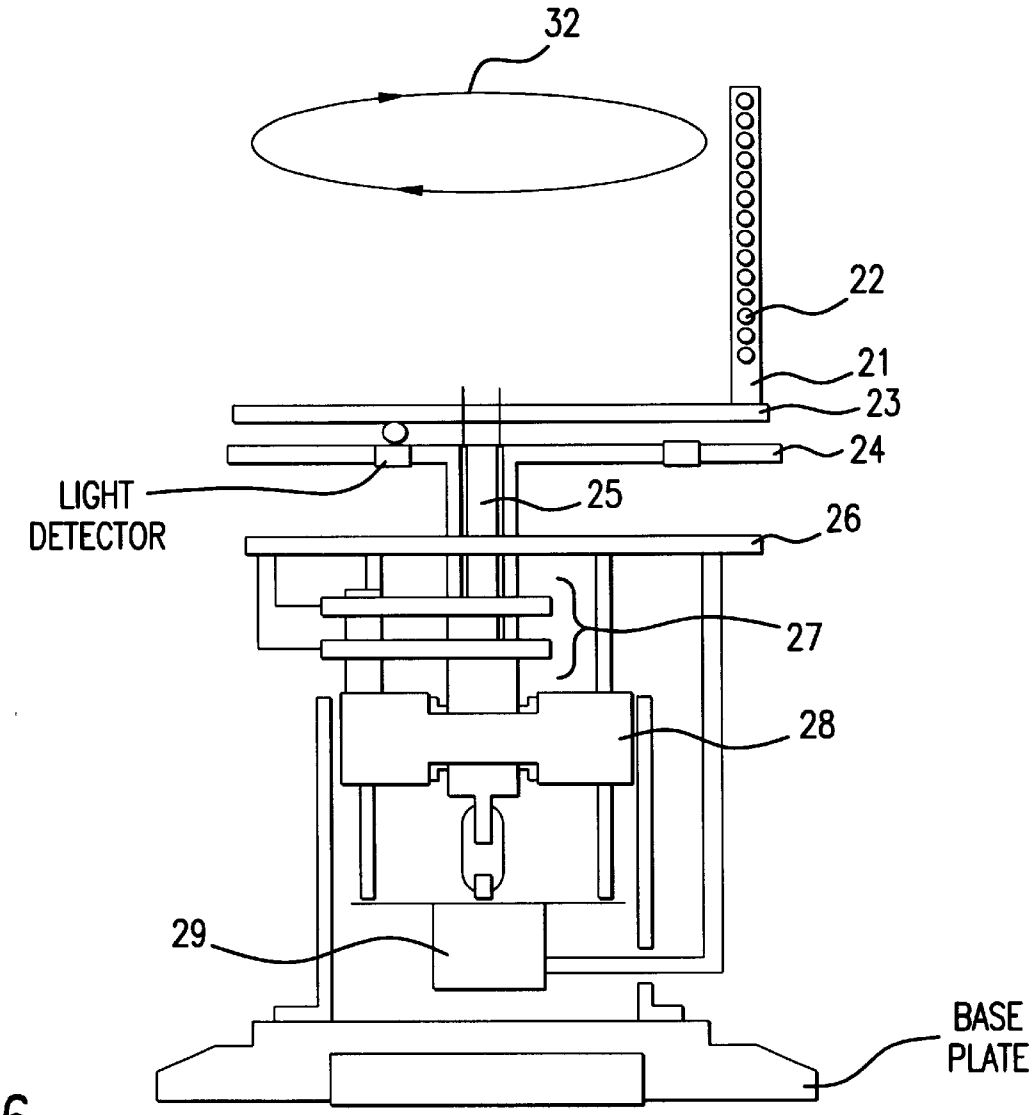
FIG. 6 is a view showing the principle of the structure of a display device with rotating light source carrier (advertising column structure)

FIG. 6 shows the basic structure of a display device in which the light source carrier performs a rotational movement about a fixed point of rotation and thus moves within a cylindrical path. In this way, it is possible to provide a 360°-display, as in the case of advertising columns. In the display device in FIG. 6, the carrier is in the form of a bar 21 with light emitting diodes 22. The bar 21 stands on a rotatable board 23 on which the electronic arrangement for display and data transfer is disposed. Disposed beneath the rotating board and connected thereto is a turntable 24, which is driven by a shaft 25. For determining the position of the rotatable board 23, the arrangement has a detector, which outputs a reference pulse to the electronic arrangement when the rotating board is in a given position.

The assembly further includes a further board 26 for wireless data transfer and for motor control. The board 26 is also connected to carbon brushes 27 for the transfer of current to the diodes 22. A bearing unit 28 carries the rotary shaft 25 and permits rotary movement thereof. The shaft 25 is driven by a drive motor 29, which is connected to the board 26 in a wireless fashion or by wire connections and is controlled by the control device.

The rotational movement 32 of the bar 21 and appropriate actuation of the light emitting diodes 22 permits a display in the manner of an advertising column, except with the difference that it is possible to see through the display itself. In the active condition, the user cannot discern how the items of information come onto the "advertising column". Such a 360°-display has considerably advantages over a picture screen as the information to be displayed can be made accessible in all directions, in particular when the information to be displayed rotates in the form of moving script or lettering around the advertising column.

In a further embodiment (not shown) the carbon brushes illustrated in FIG. 6 are replaced by a generator-type structure, that is to say, carried on the shaft itself is the rotor of a current generator which is surrounded by the stator. That arrangement permits contact-less or moment-less power transfer which from the outset avoids the wear of carbon brushes and in addition contributes to reducing noise.

Instead of only one bar 21, one of ordinary skill in the art will appreciate that it is also possible to provide a plurality of bars having light emitting diodes, which allows the rotational speed to be reduced. As in any case relatively high centrifugal forces act on an individual bar, it is advantageous to respectively arrange in mutually opposite relationship bars which are connected together at the free ends in order thereby to ensure a bar arrangement which affords structural security. In addition, it is desirable for the rotatable part, that is to say bar and rotatable board and also the turntable, to be covered with a cylinder having a transparent wall in order to prevent collisions between the bar and other articles. If the interior of the cylinder is pumped empty of air, the reduction in noise can be improved as there is then no longer the possibility of air molecules colliding with the bar. If only one bar is provided in the structure shown in FIG. 6, the rotational frequency should be about 25 Hz in order to permit a display of attractive quality. In each revolution, an optical detector pulse is produced, which is supplied as a reference signal to the electronic control system and thus permits synchronisation.

Figure 5:
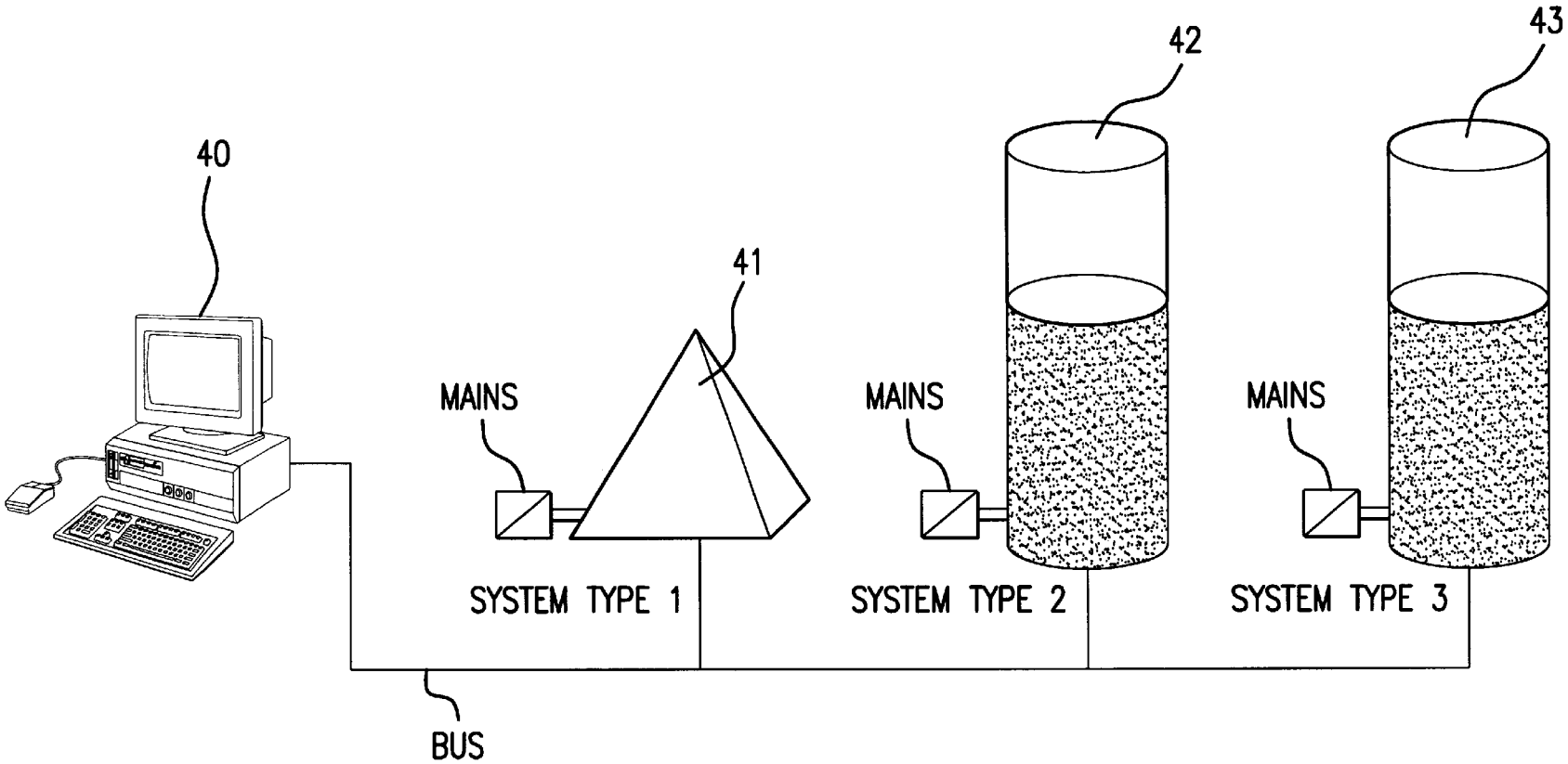
FIG. 5 is a view of an arrangement of a plurality of display devices connected to a computer.

FIG. 5 shows the structure in principle of a display system comprising various display devices 41, 42, and 43—either with a pendulum display or with an advertising column display—which are connected by way of a bus—for example BRS 485—to a personal computer as the information input/processing device 40. By virtue of such a configuration, paired with suitable PC-software which allows display control of the individual display devices, it is possible to input suitably desired display information, to put the information into intermediate storage in the PC, and to output that stored information to the display devices where the information is then reproduced.

Preferably, each individual display device is provided with an electronically selectable address so that the PC can not only select all display devices simultaneously but also individually, for information reproduction. Such an address can be for example a digitally encoded number.

Additional information regarding the construction and use of conventional rotational displays may be found in PCT document 195 02 735.3 or PCT/DE96/00117. Some particularly useful additional points of note include (1) Automatic shut-down in an irregular operating condition; (2) oscillation damping; (3) electronically aided balancing of the machine; (4) color mixing digitally by superimposition of the three primary colors at a point; (5) color mixing in analog fashion by superimposition of the three primary colors at a point; (6) electronic 120° actuation with mechanical displacement compensation; (7) free motor rotation and thereby use of unregulated drives; (8) arrangement of lighting means in the inner circle, thereby greater utilisation of the display surface area; (9) three-dimensional arrangement of the lighting means; and (10) bidirectionality of data transfer.

Each of these points are discussed in some additional detail below in relation to the present invention.

(1) Automatic Shut-Down in an Irregular Operating Condition

Automatic monitoring of the regular operating condition of the system is absolutely necessary in order to guarantee the safety of the system. The system develops enormous forces, which in the operating condition are checked to ensure that they are in balance. The basic principal involved in this respect is that the system rotates and all forces are in equilibrium. If for any reason, for example, a component in the system were to come loose: an unbalance state would occur, depending on the respective weight and position of the component. The inevitable consequence of such an unbalance is system vibration. Vibration may be detected and electronically evaluated. If system unbalance is registered over a certain period of time (being of a value, which is above or below a threshold value), the system is then automatically switched off. This means that the system must always be in a defined condition in order to start up at all.

Figure 7:
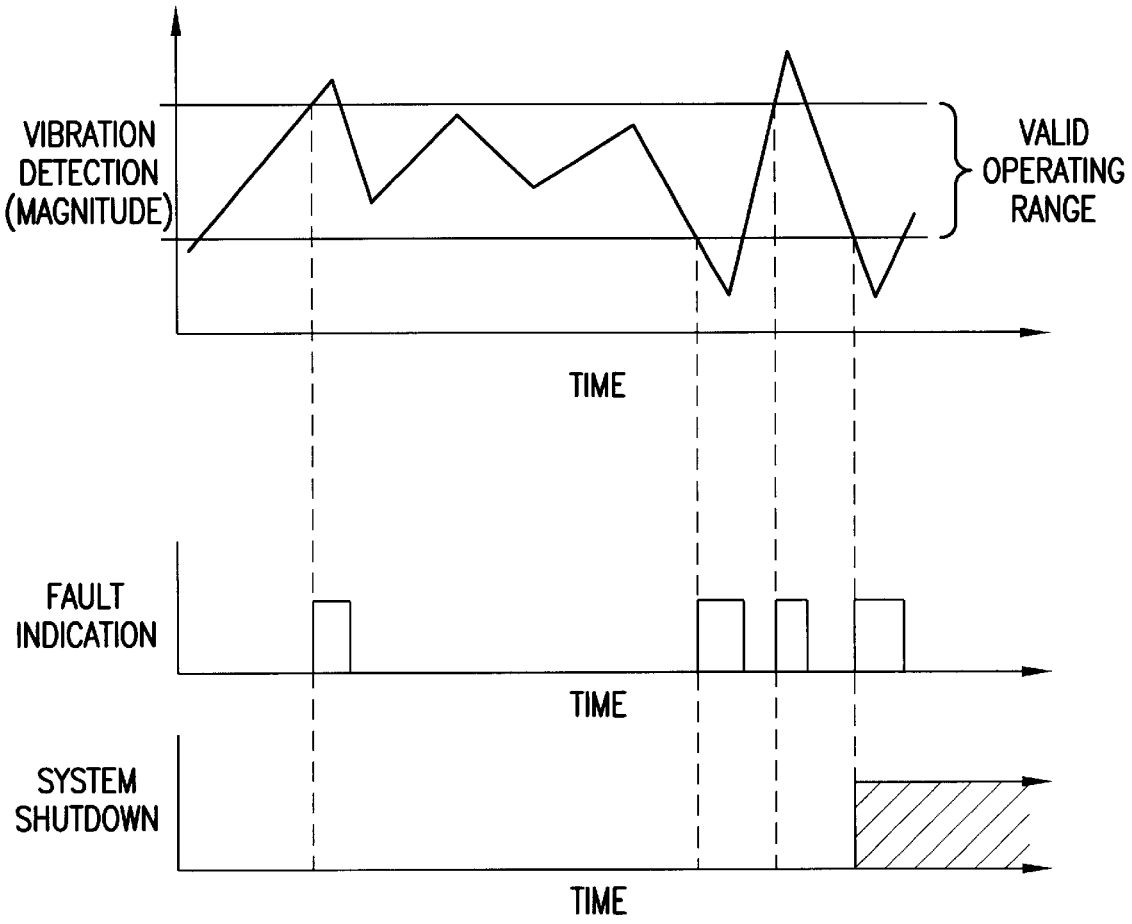
FIG. 7 shows an oscillation/time diagram of a display device according to the invention.

As can be clearly seen in FIG. 7, the fact that the valid operating range is exceeded does not directly result in the system being switched off. It is only when the operating range is exceeded over a certain period of time that the system shutdown procedure comes into operation.

That system shutdown procedure can only be deactivated by pressing a switch.

The condition of shut-down of the system also results in the generation of a message by way of the communication bus to the main computer.

(2) Oscillation Damping

Oscillation damping of light vibrations is effected by way of vibration dampers or arrangements referred to as rubber-metal damping connections. The use of such vibration dampers involves two essential purposes. On the one hand, light frequencies (for example noise) are not transmitted to the fixed basic frame structure. On the other hand, for vibration measurement purposes, it is possible to use a light barrier arrangement, which can measure the mechanical difference between fixed and oscillatingly mounted parts. The signal U_oscillation can thus be very easily produced.

(3) Electronically Aided Balancing of the Machine

Each rotational system must be subjected to factory setting after assembly. This factory setting is necessary in order to compensate for differences, which occur in the course of display device production. It will be very difficult to build a system, which immediately runs true. Thus, for example, in the case of any motor vehicle the tires always have to be balanced in order to guarantee optimum-running truth thereof. That problem also occurs in the case of a rotational display system. In order to detect an unbalanced state, the signal U_oscillation is simply viewed with an oscilloscope. That signal is to be brought into a condition of perfect synchronism by the fitting of suitable weights. The problem in this respect is not detecting and optimising static unbalance but detecting and compensating for dynamic unbalance.

(4) and (5) Color Mixing in Analog Fashion

The rotational display device according to the present invention for the first time affords the possibility of mechanically displaying colors in linear relation one to another. Based on the fact that, at certain frequencies, the human eye mixes individual pulses to form an image, it is possible in this respect to have recourse to this effect. Conventional displays such as for example a television or an LED-wall mix the primary colors red, green and blue.

The disadvantage however lies in the resolution. The colors are displayed in side-by-side relationship. If the human eye is not sufficiently far away from that point, the human being does not see the three individual colors separately, but combines them to form a mixed color from the relationship of the individual colors.

Figure 8:
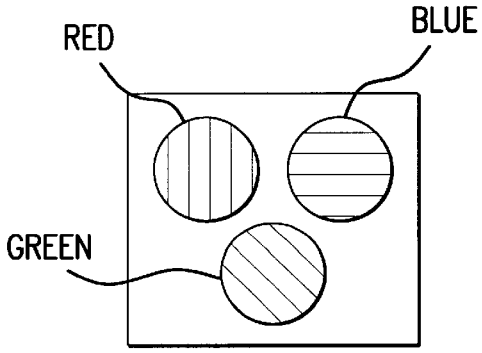
FIG. 8 shows a plan view of a colored light source arrangement.
Figure 9:
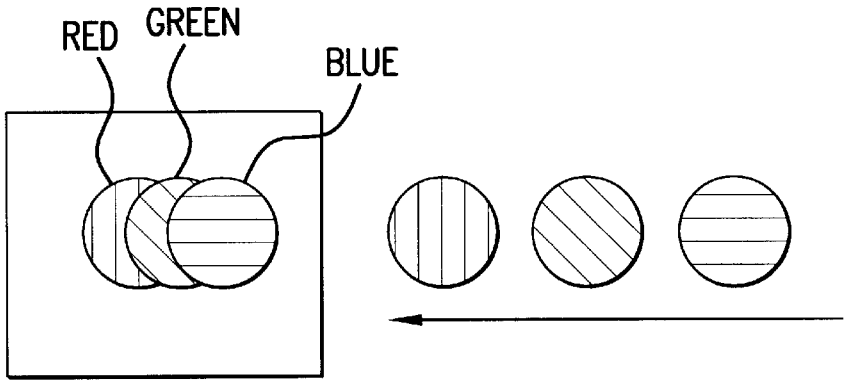
FIG. 9 shows a view of the coloration effect by the superimposition of moving colored light sources.

By virtue of mechanical mixing of the lighting means red, green and blue in a suitable ratio by an arrangements shown, for example in FIGS. 8 and 9, the resulting color can be produced at a virtually virtual point.

Figure 10:
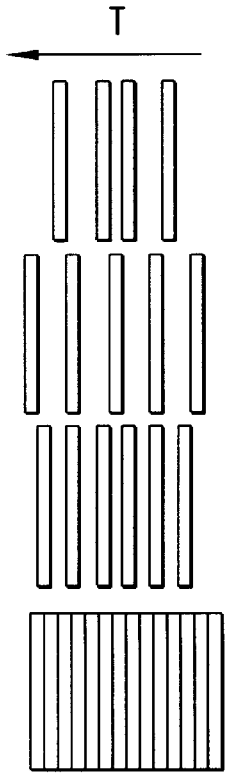
FIG. 10 shows an alternative configuration to the display illustrated in FIG. 9.

It is thus possible to achieve a very high degree of resolution as the mechanical limitation in regard to the light point ceases to apply. Digital mixing of the colors over a point in the virtual matrix is effected by suitable actuation (on-off). That has the advantage that electronic actuation becomes very simple. The intensity of the individual primary colors is controlled by a suitable pulse duty factor. See, for example FIG. 10. The information is ready in a suitable storage means.

The digital mixing method can be suitably adapted by virtue of connecting an RC-member into circuit, as an RC-member acts like an integrator.

Figure 11:
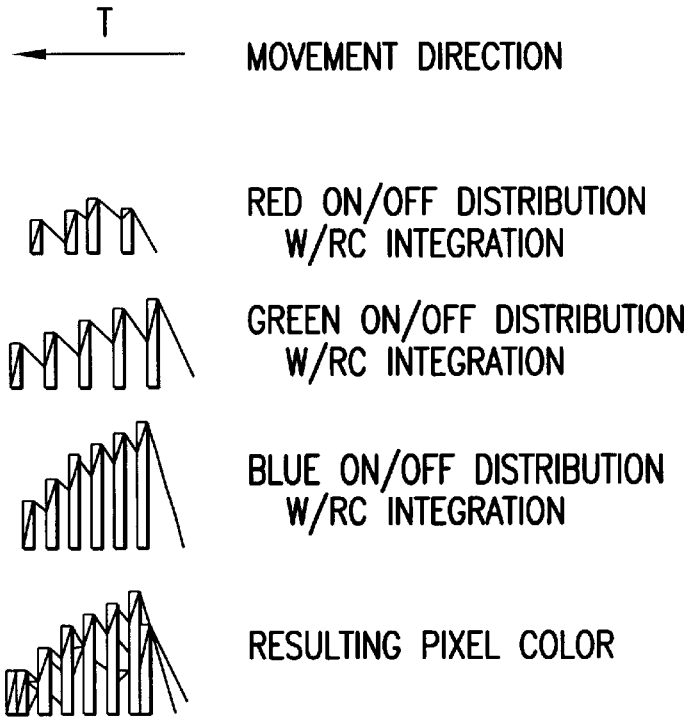
FIG. 11 shows a further alternative view for producing color.

As illustrated in FIG. 11, the RC-member in an actuation system must be suitably tuned to the display frequency. That provides a virtually analog adaptation effect.

In addition however it is also possible for the color pixel to be operated with a suitable level of intensity over the period of time T. That, however, requires a relatively complex hardware set-up.

Figure 12:
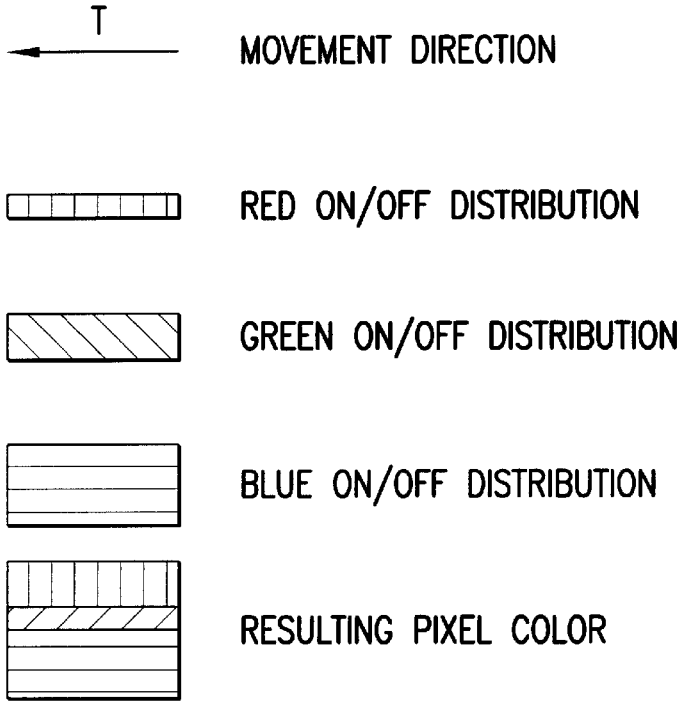
FIG. 12 shows a further alternative view of producing color from individual colors.

As shown in FIG. 12, during the time T, a pixel must reach and hold a suitable level of intensity.

(6) Electronic 120° Actuation

The use of three colors is achieved preferably with three bars, which are in a 120°-relationship with each other. Each bar includes either all three primary colors or each bar includes only one primary color. At any event, there must be synchronisation of the three colors at the corresponding moment in time T. A minimal displacement would result in an indistinct and blurred image. Furthermore, it is not possible to absolutely guarantee that all pointers are always mechanically disposed, with the lighting means, on the same vertical axis. Minor errors caused by the production procedure will always be present. In order not to mechanically measure and especially compensate for that point, the electronic system operates to compute a displacement of 120° and a suitable production error is incorporated in the computation as a compensation factor.

Figure 13:
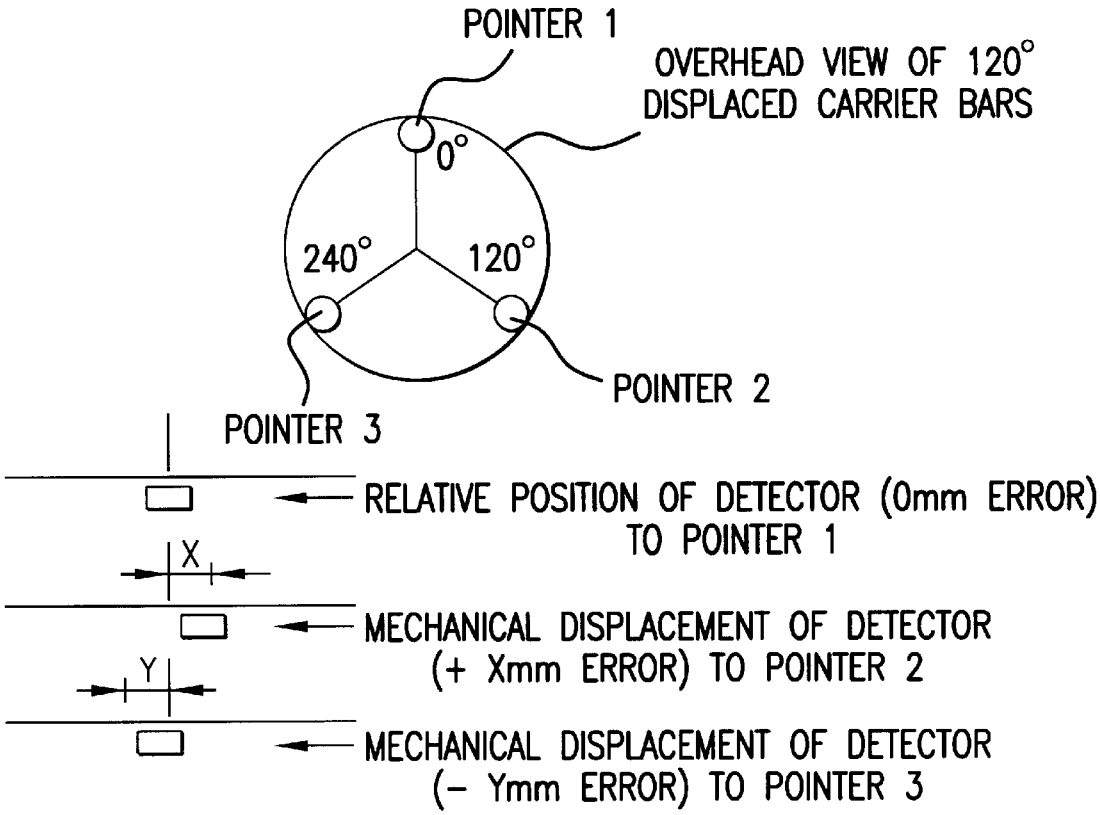
FIG. 13 is a view of electronic compensation of mechanical displacement of three pointers.

It can be seen from FIG. 13 that the position of pointer 2 at +x mm and the position of pointer 3 of −y mm deviate from the ideal position.

This displacement remains disregarded in production and is only individually detected in the procedure for final testing for each system. In that respect the speed of rotation is irrelevant. The calculation of the 120° support points is ascertained with each passage and is re-calculated for the following passage. In that case, the displacement differences are also suitably incorporated in the computation. Input of the differences is effected with a suitable service and setting software program.

(7) Free Motor Rotation

The use of a motor regulation arrangement is not absolutely necessary in the display device according to the present invention. By virtue of the 120° computation, the system is capable of measuring the speed of rotation only by measurement of the revolution duration by means of a light barrier arrangement. The resulting computation of the system-typical parameters is thus implemented in respect of each revolution. That in turn makes it possible to use simple, unregulated drives. These systems are less expensive. As the μcontroller on the system does not communicate the display data directly to the pointers, it has sufficient time for that higher-order calculation.

(8) Arrangement of Lights Within an Inner Circle

Figure 14:
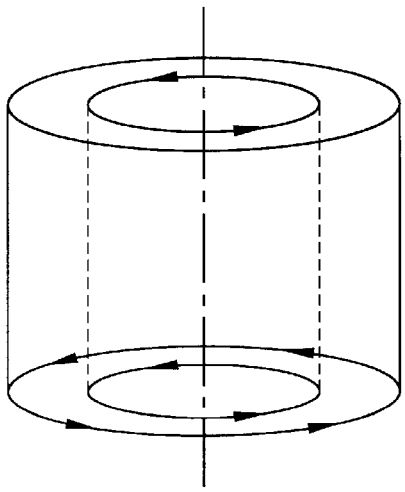
FIG. 14 is a view of a rotational display from below with a further display arranged at an inward location.

The arrangement of lighting means on the inner circle makes it possible also to make better use of the display surface area. That is particularly advantageous in regard to systems, which are mounted under the cover. Not only the outer peripheral surface but also the inner peripheral surface are used. Thus, when viewing from below, a part of the information can also be read in the inner region. See, FIG. 14.

(9) Three-dimensional Arrangement of Lighting Means

Figure 15:
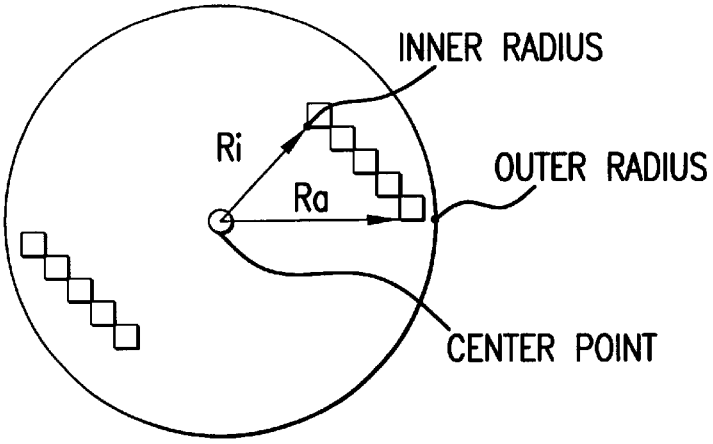
FIG. 15 is a view of a light source arrangement for generating a three-dimensional display.

By way of a pointer arrangement extending into the middle space, it is also possible to show physical letters or three-dimensional parts. See, FIG. 15.

Figure 16:
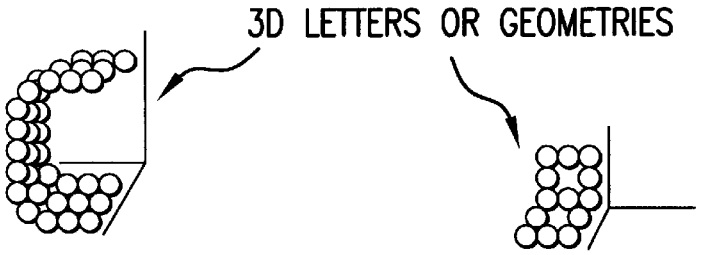
FIG. 16 shows an example of a three-dimensional display generated by a light source arrangement as shown in FIG. 15.

The lighting means, which are disposed on the outer radius, are displayed with the lighting means, which are disposed continuously further inwardly. It is thus possible to give a suitable depth to a lighting point. The lighting means are also arranged one below the other on the pointers. See, FIG. 16.

Letters or geometries can also be spatially represented by way of the depth effect.

(10) Bidirectional Data Transfer

Figure 17:
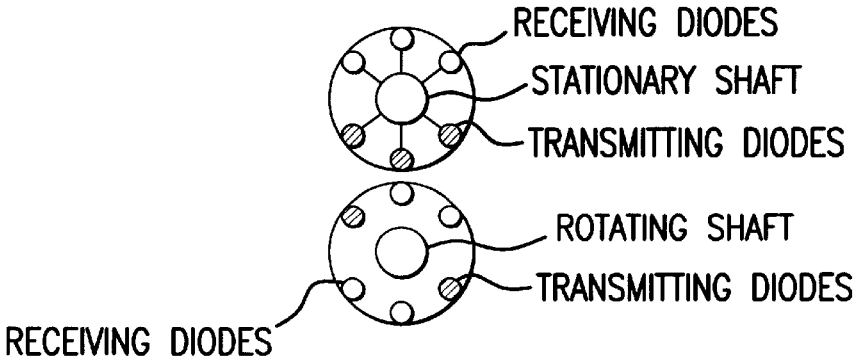
FIG. 17 shows an arrangement of receiving and transmitting diodes for contact-less infrared data transfer.

The contact-less infrared data transfer of the systems is bidirectional. This means that data are simultaneously transmitted and received. It is thus also possible for status information to be communicated from the system to the main computer. Furthermore, items of data information are acknowledged as being correctly received by the system. Data transfer is effected in each case by way of two transmitting diodes and three/four receiving diodes, which are so arranged that they can always transmit and receive at any time in the revolution. The arrangement can be seen in FIG. 17. The particularity of the arrangement is that, at any rotational relationship, the arrangement always ensures that it is possible to both transmit and also receive. The spacing of the elements is always 60° relative to each other. In the case of the stationary part, it is even possible to omit a receiving diode.

What is claimed is:

1. An advertising column display device comprising:

a rotatable carrier comprising a bar member and a plurality of light sources arranged on the bar member;

a drive adapted to rotate the carrier, such that the plurality of light sources repeatedly passes over a surface region, thereby defining a virtual matrix;

a memory storing display information;

a control device controlling the drive and actuating of the plurality of light sources in relation to the display information;

wherein the plurality of light sources comprises a first arrangement of light sources and a second arrangement of light sources, wherein the first and second arrangements of light sources define a plurality of display rows within the virtual matrix; and, wherein the control device selectively actuates within a single display row a first light source having a first color from the first arrangement of light sources, and a second light source having a second color, different from the first color, from the second arrangement of light sources at a common point within the virtual matrix to effect chromatic mixing of the first and second colors.

2. The display device of claim 1, wherein the plurality of light sources comprises a first arrangement of red light sources, a second arrangement of green light sources, and a third arrangement of blue light sources.

3. The display device of claim 1, wherein the plurality of light sources comprises a first arrangement of tri-colored light sources and a second arrangement of tri-colored light sources.

4. The display device of claim 1, wherein the control device defines an ON/OFF duty cycle for each light source in the plurality of light sources by means of digital duty cycle signals.

5. The display device of claim 4, wherein the control device further comprises an RC circuit integrating the digital duty cycle signals for an individual light source in the plurality of light sources.

6. The display device of claim 4, wherein the control device further defines light strength for the light sources in the plurality of light sources in relation to the display information.

7. The display device of claim 6, further comprising an ambient light detector, wherein the control device further defines light strength for the plurality of light sources in relation to a indication from the ambient light detector.

8. The display device of claim 1, wherein the carrier further comprises:

a rotatable board supporting a first vertical bar member and a second vertical bar member;

a first plurality of light sources arranged on the first vertical bar member, wherein the first plurality of light sources comprises a first arrangement of light sources and a second arrangement of light sources defining a first plurality of display rows within the virtual matrix;

a second plurality of light sources arranged on the second vertical bar member, wherein the second plurality of light sources comprises a third arrangement of light sources and a fourth arrangement of light sources defining a second plurality of display rows within the virtual matrix;

wherein the control device selectively actuates within a single display row of the first plurality of display rows a first light source having a first color from the first arrangement of light sources, and a second light source having a second color, different from the first color, from the second arrangement of light sources at a common point within the virtual matrix to effect chromatic mixing of the first and second colors; and, wherein the control device selectively actuates within a single display row of the second plurality of display rows a third light source having a third color from the third arrangement of light sources, and a fourth light source having a fourth color, different from the third color, from the fourth arrangement of light sources at a common point within the virtual matrix to effect chromatic mixing of the third and fourth colors.

9. The display device of claim 8, wherein the memory further stores displacement information indicating variance between the first and second plurality of display rows in the virtual matrix, and wherein the control device selectively actuates light sources in the first and second plurality of light sources in relation to the display information and the displacement information.

10. The display device of claim 1, further comprising:

a shutdown switch connected to the drive;

means for detecting mechanical vibration and outputting a vibration signal indicative of an amount of detected mechanical vibration;

wherein the control device is adapted to receive the vibration signal and determine whether the vibration signal has exceed a shutdown threshold, and to actuate the shutdown switch upon determining that the vibration signal has exceeded the shutdown threshold.

11. The display device of claim 10, wherein the shutdown threshold is a value defined by a vibration signal magnitude and a duration in time.

12. The display device of claim 1, wherein the carrier further comprises:

a first bar having a first plurality of light sources arranged thereon;

a second bar having a second plurality of light sources arranged thereon;

a rotatable board having a substantially planar principal surface and fixing the first and second vertical bars in positions 180° apart within the principal surface;

wherein the first and second bars are each fixed on the rotatable board at angles other than normal to the principal surface.

13. A display arrangement comprising:

a plurality of display systems connected to a personal computer via a bus;

wherein at least one of the plurality of display systems comprises:

a movable carrier, a plurality of light sources arranged on the carrier, a drive adapted to move the carrier in a pattern such that the plurality of light sources repeatedly passes over a surface region thereby defining a virtual matrix;

a memory storing display information received from the personal computer via the bus, and a control device generating a drive control signal for controlling the drive and a light source actuation signal for selectively actuating the light sources in the plurality of light sources in response to the display information;

wherein the plurality of light sources comprises a first arrangement of light sources and a second arrangement of light sources, wherein the first and second arrangements of light sources define a plurality of display rows within the virtual matrix; and, wherein the control device selectively actuates within a single display row a first light source having a first color from the first arrangement of light sources, and a second light source having a second color, different from the first color, from the second arrangement of light sources at a common point within the virtual matrix to effect chromatic mixing of the first and second colors.

14. The display arrangement of claim 13, wherein each display system in the plurality of display systems is electronically selectable by the personal computer using a unique address.

15. The display device of claim 1, wherein the control device and memory are adapted to receive display information from an external source via a telephone line connection.

16. The display device of claim 1, wherein the first arrangement of light sources comprises a first columnar arrangement of light sources having first color, and the second arrangement of light sources comprises a second columnar arrangement of light sources having second color, wherein the second columnar arrangement of light sources is disposed in parallel with the first columnar arrangement of light sources along the length the bar member.

17. The display device of claim 1, wherein the rotatable carrier comprises a circular plate supporting first, second, and third bar members thereon, wherein the first, second and third bar members are supported at respective support points separated by 120° around a circumference within the circular plate, and wherein the first, second and third bar members respectively comprise a first, second, and third plurality of light sources.

18. The display device of claim 17, wherein each one of the first, second and third plurality of light sources associated with the first, second, and third bar members comprises a first arrangement of red light sources, a second arrangement of green light sources, and a third arrangement of blue light sources.

19. The display device of claim 17, wherein each one of the first, second and third plurality of light sources associated with the first, second, and third bar members comprises an arrangement of tri-colored light sources.

20. The display device of claim 18, wherein the first arrangement of red light sources, the second arrangement of green light sources, and the third arrangement of blue light sources are dispose vertically in relation to a horizontal direction defined by the display row, and in parallel one to another.

21. The display device of claim 20, further comprising within the control device, means for calculating respective 120° support points around the circumference of the circular plate in relation to the first, second, and third bar members.

22. The display device of claim 21, further comprising within the control device, means for actuating any individual light source within the first, second, and third plurality of light sources in relation to a calculated 120° support point and a measured variance between the calculated 120° support point and the individual light source.

23. The display arrangement of claim 13, wherein the bus comprises a telephone line.

24. An advertising column display device comprising:

a rotatable carrier comprising a bar member and a plurality of light sources arranged on the bar member;

a drive adapted to rotate the carrier, such that the plurality of light sources repeatedly passes over a surface region defining a cylindrical virtual matrix;

a memory storing display information;

a control device controlling the speed of the drive and actuation of the plurality of light sources in relation to the display information, such that a visually persistent image is formed over the entire cylindrical virtual matrix;

wherein the plurality of light sources comprises a first arrangement of light sources and a second arrangement of light sources, wherein the first and second arrangements of light sources define a plurality of display rows within the cylindrical virtual matrix; and, wherein the control device selectively actuates within a single display row a first light source having a first color from the first arrangement of light sources, and a second light source having a second color, different from the first color, from the second arrangement of light sources at a common point within the cylindrical virtual matrix to effect chromatic mixing of the first and second colors around the entire row-wise circumference of the cylindrical virtual matrix.

25. The display device of claim 24, wherein the first arrangement of light sources comprises a first columnar arrangement of light sources having first color, and the second arrangement of light sources comprises a second columnar arrangement of light sources having second color, wherein the second columnar arrangement of light sources is disposed in parallel with the first columnar arrangement of light sources along the length the bar member.

26. The display device of claim 24, wherein the rotatable carrier comprises a circular plate supporting first, second, and third bar members thereon, wherein the first, second and third bar members are supported at respective support points separated by 120° around a circumference within the circular plate, and wherein the first, second and third bar members respectively comprise a first, second, and third plurality of light sources.

27. The display device of claim 26, wherein each one of the first, second and third plurality of light sources associated with the first, second, and third bar members comprises a first arrangement of red light sources, a second arrangement of green light sources, and a third arrangement of blue light sources.

28. The display device of claim 26, wherein each one of the first, second and third plurality of light sources associated with the first, second, and third bar members comprises an arrangement of tri-colored light sources.

29. The display device of claim 27, wherein the first arrangement of red light sources, the second arrangement of green light sources, and the third arrangement of blue light sources are dispose vertically in relation to a horizontal direction defined by the display row, and in parallel one to another.

30. The display device of claim 29, further comprising within the control device, means for calculating respective 120° support points around the circumference of the circular plate in relation to the first, second, and third bar members.

31. The display device of claim 30, further comprising within the control device, means for actuating any individual light source within the first, second, and third plurality of light sources in relation to a calculated 120° support point and a measured variance between the calculated 120° support point and the individual light source.

* * * * *